US008720009B2

(12) United States Patent
Schneider

(10) Patent No.: US 8,720,009 B2
(45) Date of Patent: May 13, 2014

(54) HINGE

(75) Inventor: Johannes Schneider, Michelau (DE)

(73) Assignee: Dr. Schneider Kunststoffwerke GmbH, Kronach (DE)

( * ) Notice: Subject to any disclaimer, the term of this patent is extended or adjusted under 35 U.S.C. 154(b) by 0 days.

(21) Appl. No.: 13/504,345

(22) PCT Filed: Dec. 3, 2010

(86) PCT No.: PCT/EP2010/068818
§ 371 (c)(1),
(2), (4) Date: Apr. 26, 2012

(87) PCT Pub. No.: WO2011/082911
PCT Pub. Date: Jul. 14, 2011

(65) Prior Publication Data

US 2012/0216371 A1 Aug. 30, 2012

(30) Foreign Application Priority Data

Dec. 14, 2009 (DE) ..... 20 2009 015 725 U

(51) Int. Cl.
*E05D 7/10* (2006.01)
*E05D 7/00* (2006.01)

(52) U.S. Cl.
USPC ..... 16/266; 16/342; 16/355

(58) Field of Classification Search
USPC ..... 16/342, 254, 260, 262, 266, 268, 355; 200/61.7
See application file for complete search history.

(56) References Cited

U.S. PATENT DOCUMENTS

| | | | | | |
|---|---|---|---|---|---|
| 32,482 | A | * | 6/1861 | Lane | 16/265 |
| 731,138 | A | * | 6/1903 | Stearns | 52/72 |
| 770,595 | A | * | 9/1904 | Lovette | 16/260 |
| 1,044,670 | A | * | 11/1912 | Liberty et al. | 280/847 |
| 1,062,623 | A | * | 5/1913 | Waters | 16/262 |
| 1,341,063 | A | * | 5/1920 | McQueen | 16/262 |
| 2,396,950 | A | * | 3/1946 | Hemphill | 188/171 |
| 2,564,511 | A | * | 8/1951 | Smith, Jr. | 411/270 |
| 3,805,325 | A | * | 4/1974 | Lee | 16/262 |
| 4,186,905 | A | * | 2/1980 | Brudy | 248/478 |
| 4,307,486 | A | * | 12/1981 | Matsumoto | 16/261 |

(Continued)

FOREIGN PATENT DOCUMENTS

| | | |
|---|---|---|
| DE | 203 05 291 | 7/2003 |
| DE | 203 18 076 | 3/2004 |

(Continued)

OTHER PUBLICATIONS

International Search Report of PCT/EP2010/068818, Mar. 15, 2011.

*Primary Examiner* — Victor Batson
*Assistant Examiner* — Jason W San
(74) *Attorney, Agent, or Firm* — Collard & Roe, P.C.

(57) ABSTRACT

The present invention relates to a hinge for pivotable connection of two components (1, 2), consisting of at least one first round hinge element (3, 4) at the first component (1) and at least one corresponding second round hinge element (5, 6) at the second component (2), which hinge elements (3, 5; 4, 6) are connected together to be rotatable about the center axis. The first hinge element (3, 4) is a bearing sleeve (7, 8) with a longitudinal gap, by way of which an insertion sleeve (11, 12), similarly provided with a longitudinal gap (13, 14), as second hinge element (5, 6) can be rotated into place in its entirety.

16 Claims, 3 Drawing Sheets

(56) References Cited

U.S. PATENT DOCUMENTS

Figure 1:
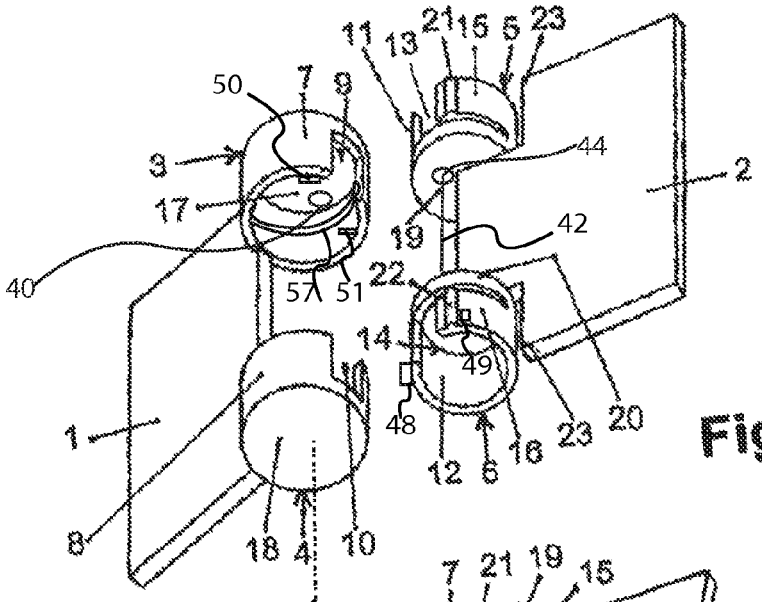

| | | | | | |
|---|---|---|---|---|---|
| 4,850,081 | A * | 7/1989 | Grant | 16/257 |
| 4,850,082 | A * | 7/1989 | Yi | 16/341 |
| 4,854,009 | A * | 8/1989 | Brockhaus | 16/263 |
| 4,858,274 | A * | 8/1989 | Harrison et al. | 16/265 |
| 4,986,507 | A * | 1/1991 | Chiang | 248/291.1 |
| 5,075,927 | A * | 12/1991 | Porta | 16/273 |
| 5,455,987 | A * | 10/1995 | Svehaug | 16/267 |
| D376,971 | S * | 12/1996 | Schutz | D8/327 |
| 5,706,556 | A * | 1/1998 | Kluting | 16/273 |
| 5,896,622 | A * | 4/1999 | Lu | 16/342 |
| 5,943,738 | A * | 8/1999 | Karfiol | 16/342 |
| 6,408,485 | B1 * | 6/2002 | Wu | 16/342 |
| 6,487,929 | B2 * | 12/2002 | Schneider | 74/527 |
| 6,642,462 | B2 * | 11/2003 | Ninomiya et al. | 200/61.7 |
| 6,671,929 | B1 * | 1/2004 | Lu | 16/342 |
| 7,051,404 | B2 * | 5/2006 | Roy | 16/355 |
| 7,451,523 | B2 * | 11/2008 | Chen | 16/342 |
| 7,513,014 | B2 * | 4/2009 | Lin | 16/374 |
| 7,607,201 | B2 * | 10/2009 | Lin | 16/330 |
| 8,015,668 | B2 * | 9/2011 | Wang | 16/338 |
| 8,020,256 | B2 * | 9/2011 | Goller et al. | 16/342 |
| 8,060,985 | B2 * | 11/2011 | Lin | 16/374 |
| 8,304,939 | B2 * | 11/2012 | Lee et al. | 310/43 |
| 8,307,508 | B2 * | 11/2012 | Cao | 16/342 |
| 2006/0069313 | A1 * | 3/2006 | Couvillon et al. | 600/179 |
| 2008/0034542 | A1 * | 2/2008 | Lee | 16/342 |
| 2009/0083941 | A1 * | 4/2009 | Hung | 16/254 |
| 2009/0083943 | A1 * | 4/2009 | Chen | 16/342 |
| 2012/0193469 | A1 * | 8/2012 | Goldstein | 242/596 |
| 2012/0216371 | A1 * | 8/2012 | Schneider | 16/268 |
| 2013/0038191 | A1 * | 2/2013 | Wang et al. | 312/326 |

FOREIGN PATENT DOCUMENTS

| | | |
|---|---|---|
| DE | 100 61 030 | 12/2004 |
| DE | 20 2004 016 117 | 3/2005 |
| DE | 103 52 445 | 11/2007 |
| GB | 2 274 896 | 8/1994 |
| GB | 2274896 A * | 8/1994 |

* cited by examiner

HINGE

CROSS REFERENCE TO RELATED APPLICATIONS

This application is the National Stage of PCT/EP2010/068818 filed on Dec. 3, 2010, which claims priority under 35 U.S.C. §119 of German Application No. 20 2009 015 725.3 filed on Dec. 14, 2009, the disclosure of which is incorporated by reference. The international application under PCT article 21(2) was not published in English.

SUMMARY

The invention relates to a hinge for pivotable connection of two components consisting of at least one first round hinge element at the first component and at least one corresponding second round hinge element at the second component, which hinge elements are connected together to be rotatable about the centre axis such a hinge is known from GB 2 274 896 A.

Hinges movably connect two planes at an edge. They are designed as a connecting joint in order to connect together two components. For example, hinges are used at doors or lids of containers for opening and closing the respective space, which is covered. There are hinges which in terms of weight can be subjected to high loading and have correspondingly strongly constructed strips and pins connecting the rotary joints together. In addition, use is made~particularly for connecting lightweight components~of hinges of plastics material, which are light, able to be produced economically in large batch numbers and can be built up in simple manner or are injection-molded at plastics material parts, which are to be connected, as film, hinges therebetween. Such hinges essentially consist of a thin-walled connection, often in the form of a fold, which through its flexibility enables limited rotational movement of the connected components. Polypropylene is preferably used as the material due to a marked resistance to wear. Film hinges have a limited capability of loading and a low shear strength. The hinge ends lead, in frequent use, to breakage or tearing. Increasingly, however, use is also made of other hinges which are composed of plastics material and consists, in classic form, of rotary joints which are injection molded at the components or lateral strips and are insertable one into the other in comb-like manner and connected together by means of a pin. The pin can similarly consist of plastics material.

Such plastics material hinges of classic mode of construction can replace hinges made of sheet steel. The known hinges basically make it necessary for the hinge parts to be connected together by a pin which has to be secured in the hole row. This takes place, for example, by a screw or by forming a second head on the pin, so that slipping through to either side is avoided. They are screw-connected in a preassembled state to the components, which are to be connected together, by way of the strap-shaped components which are provided as strips. This requires skillful dexterity. If the two hinge halves are mounted on components beforehand and then inserted one into the other in order to be able to connected by a pin, a precise preassembly of the two hinge halves at the respective components is required.

If the hinge halves at the same time serve the purpose of connecting together two plastics material parts, then the separate production and separate mounting of such a hinge represents a high level of assembly effort. Since, for example, a small container, which is closed by a lid pivotably fastened thereto by way of a hinge, is relatively cheap, the hinge of plastics material of known mode of construction is relatively expensive. Replacement by a film hinge is usually not feasible if the lid is to be frequently used, such as, for example, in the case of a cover of a storage compartment in a motor vehicle. Moreover, braking moments in the known hinges are not preset. It is accordingly known to separately insert braking means in such hinges into order to produce defined levels of friction so as to achieve desired slide properties or braking characteristics during actuation of the hinges. For example, it can be achieved by this means that the cover can be kept open in different inclined settings.

Starting from the known prior art the invention has the object of so constructing a hinge of the kind according to category that the two hinge elements can be easily mounted at the components to be connected and that they can be joined radially one in the other without the use of a pin. Through material selection or by constructional design these components are suitable for exerting a defined braking moment. A further object consists in limiting the pivot travel of the hinge. The invention fulfills the task by construction of the hinge. Each individual hinge accordingly consists of a first hinge element, which forms a bearing sleeve having a longitudinal gap. This hinge element is fastened to or formed on the first component to protrude at a longitudinal side in such a manner that the bearing sleeve in practice protrudes beyond the edge. The longitudinal gap which separates the bearing sleeve and has a defined width is in that case disposed in the region of the circumferential wall of the bearing sleeve opposite the fastening to the component. The position does not have to be exactly opposite and the longitudinal gap can also be provided to extend at an angle to the plane of the component. The clear width of the longitudinal gap should stand in a specific ratio to the outer diameter, the total length and the wall thickness. An insertion sleeve, similarly provided with a longitudinal gap, is mounted on the second component as second hinge element. The insertion sleeve is so fastened by at least one end face to the second component that the circumferential surface of the insertion sleeve is circumferentially free. The longitudinal gap of the insertion sleeve is arranged to be freely accessible for insertion into the longitudinal gap of the bearing sleeve. In addition, the outer diameter of the insertion sleeve is matched to the inner diameter of the bearing sleeve. The outer diameter is smaller, for example by twice the wall thickness of the bearing sleeve if the wall thicknesses of the two sleeves are selected to be of the same size. In every case the outer diameter of the insertion sleeve should be so dimensioned that with consideration of the resilient design of the circumferential wall the insertion sleeve introduced into the bearing sleeve can rotate.

At least the insertion sleeve has at least one sleeve wall section which extends at one side of the longitudinal gap and is of resilient construction. Here, too, the width of the longitudinal gap is dimensioned in correspondence with a specific relationship to the outer diameter, the overall length and the wall thickness, so that introduction of the longitudinal gap of the insertion sleeve into the longitudinal gap of the bearing sleeve and a subsequent rotation into place is possible. Through simultaneous relative rotation of the components with respect to one another the insertion sleeve is completely rotated into the bearing sleeve, wherein the lateral circumferential wall sections of the insertion sleeve are, with utilization of intrinsic resilience or the resilience of the circumferential wall of the bearing sleeve, slightly turned towards one another during the rotation into place, and when the circumferential wall of the insertion sleeve is completely drawn into the bearing sleeve bears against the inner wall of the bearing sleeve. In that regard, the friction between the two hinge elements is determined in correspondence with the selected inner diameter of the bearing sleeve and the outer diameter of the insertion sleeve or the design of a resilient limb in the circumferential wall of the bearing sleeve. This friction is, however, also presettable in variable manner, for example the tube-spring stress can be designed to be variable and thermostable by means of an additional element of metal which is inserted into the insertion sleeve and which has a defined spreading action on the insertion sleeve.

By way of example, an annular C-spring-can be suitable as additional element. The friction force between the two sleeves which can be joined one in the other can be defined in numerous modes and manners also at the sleeves. If, for example, a continuous circumferential wall section in the immediate vicinity of the longitudinal gap of the insertion sleeve is formed to be resilient, for example is somewhat more thinly-walled or resilient than the rest of the wall section, then this wall section produces a defined contact pressure at the inner surface of the bearing sleeve. The contact pressure can, however, also be set in that resilient tongues are provided or formed to protrude from the circumferential wall and, when the rotation one into the other takes place, resiliently bear against the inner side of the bearing sleeve circumferential wall. Equally, such sections and corresponding co-operating sections can be provided in the bearing wall. If, however, penetration of liquid into the hinge is to be avoided as far as possible, then the bearing sleeve should usually have a closed form apart from the longitudinal gap formation. The insertion sleeve can be fastened in simple manner to a wedge-shaped fixing surface of the component by way of, for example, its edge at the end face. The end face can also be formed entirely at the component. The bearing sleeve, there against, is always fastened to a longitudinal edge of the first component. The bearing sleeve and also the insertion sleeve can, for example, also be bent from thin sheet metal or spring sheet metal, such as bronze sheet metal. However, the invention offers advantages particularly when the hinge elements consist of plastics material and are injection-molded on the component directly in the injection molding process. No separate assembly processes, such as screw connecting, riveting, soldering or welding, then need to be undertaken here. Moreover, if the hinge element is a constituent of the component this can then be produced with a slight increase in tool price.

In principle, the bearing sleeve and the insertion sleeve can be longitudinally slit hinge elements. In this case, it has to be ensured that, for example, a lateral displacement in the assembled state is not possible due to lateral bearing limitation of the lid at a container. The problem of lateral displacement can, however, also be solved in simple manner if at least respective paired bearing sleeves with open or closed base are arranged at the first component and correspondingly thereto at least respective paired insertion sleeves with open or closed base are arranged at the second component. If two such hinges are arranged at a spacing from one another and it is ensured that, for example, the closed or open base of the bearing sleeves is disposed at the outer side and the closed or open base of the bearing sleeves is disposed at the inner side, then it is evident that after joining the paired hinge elements one in the other a relative lateral displacement of the two components is no longer possible.

The open base can, for example, be a protruding annular flange so that, for example, a cable can also be led through the tubular hinge. This has particular advantages if the hinge, for example, connects two components in a motor vehicle which are to be movable relative to one another and a wiring loom is to be conducted via the connection. Through the central guidance of the wiring loom through the tubular hinge there is no mechanical loading of the wiring loom. In addition, it is evident that through use of a closed base no liquid can penetrate into a hinge. This would indeed in principle be possible via the longitudinal gap in the bearing sleeve, but since the longitudinal gaps in the two sleeves are offset relative to one another in such a manner that in the case of normal pivot movement the longitudinal gap in the bearing sleeve is covered by the wall section of the insertion sleeve, penetration of liquid is not possible. In the case of use of particularly thin walls and materials with inherent resilience, particularly with respect to the insertion sleeves, it is also possible to mount a closed base at the circumferential wall of the insertion sleeve. With use of the resilience, rotation into place in the bearing sleeve is nevertheless possible. An insertion can be substantially facilitated in that a section of the circumferential wall is cut free longitudinally of the base so that this section is exposed as a resilient section. In the case of integrally forming or cutting free a resilient section, it is also possible to provide at the section itself a detent element protruding at the-outer side, a separate brake surface of a different material, or a coating. In the case of a detent element this can be, for example, a longitudinal bead which is formed integrally or, in the case of use of sheet metal, pressed in. This bead can be so arranged that for pivot travel limitation it engages against an edge of the longitudinal gap in the bearing sleeve, wherein through flank matching a further pivotation in at least one of the two rotational directions is possible or not possible. Through provision of a slide-over surface, rotation in a desired direction beyond the edge of the longitudinal gap can be made possible. However, for a detented setting it is also possible to form in the inner wall of the bearing sleeve several detent recesses into which the detent element or the detent elements at the outer side of the circumferential wall of the insertion sleeve can engage when rotation takes place. Such detent elements can also be provided at the cut-free or mounted spring elements. Through the provided detents a ratchet function is imparted by micro-detents, whereby it is possible to be able to retain one component in different detent settings relative to the other in simple manner. If, for example, such a hinge is used in connection with display screens fastened to headrests, then the detent settings of the display screens can thereby be set in simple manner at different angles—of inclination with respect to the individual viewer.

Obviously, such detent functions can also be provided at hinges which, for example, are used with panels and other components, where this is desired.

The advantageous forms of embodiment are indicated in detail in the subclaims. Since the two hinge elements which interengage form cavities., such a hinge is particularly suitable for a cable guide. The cable can in that case be pulled axially through a row of the hinge elements if a hinge strip is concerned, but it can also end behind each individual hinge. For the pulling through, the end wall is to be provided with a passage bore or such a wall is to be dispensed with. In such a case the components would have to be connected with the end surfaces.

Since the cavity is present in any case, use can also be made of other functional inserts, for example even a lamp or a light-emitting diode, which is arranged in a housing and which at the rear side has a cable connection which is led through the center bore or through a continuously open hinge according to the invention. This light-emitting diode can be used for the purpose of illuminating the hinge as such. However, the light can also issue between the two adjacent hinge elements. Ambient lighting effects can thus be realized directly or also indirectly. If, for example, a hinge according to the invention is used for the panel of a mirror at a sun visor in a motor vehicle, then there can also be provided between the adjacent hinge elements a continuous light source which is inserted into the cavities of the adjacent hinge bodies in order to illuminate the mirror. In principle, hinges constructed in accordance with the invention can thus be used in conjunction with lamps where surfaces are to be illuminated when a flap is opened. In that case, the cavities of the hinges can also serve, since they are opposite one another, as accommodation for lamp bodies. Obviously, such hinges can also be used in fold-out lamps, for example reading lamps in a motor vehicle. A reflector curved about the longitudinal axis at a defined radius can also be mounted between the hinges, for example formed at the component, in order to be able to allow the light to issue in a specific direction when the hinge is pivoted.

It is often desired for hinges, insofar as they do not have detents, to have a non-physical, smooth motion. In the case of the hinge constructed in accordance with the invention this is already imparted just by the spring forces of the circumferential walls.

However, in addition silicon inserts, whether in flat form or in annular form, can also be used to achieve a specific desired sliding property between the mutually adjoining surfaces. For this purpose it is also possible to form grooves in the circumferential walls, into which grooves such elements are inserted, for example also a silicon 0-ring, which produces a damping frictional characteristic. If beyond that it is desired to achieve rotational movements with defined damping, then it is possible to insert in the cavity, which is formed by the hinge elements, a brake element which co-operates with the circumferential wall. Such brake elements serve for damping the rotational movement and consist of a rotor, which, for example, is rotatably mounted in a bearing socket, wherein the motor and the bearing socket are arranged to be rotatable relative to one another. In that case either the rotor can be connected with the element and the bearing socket statically fixed to a housing or to a mount or the bearing socket together with the element and the rotor can be fixed in stationary position to a housing or a mount of the hinge. The housing is formed by the circumferential walls of the bearing sleeve or the insertion sleeve. The at least individually provided brake device in that case exerts a braking force on the circumferential walls. The rotor can then bear by spring action or magnetic effect. Examples thereof are described in DE 103 52 445 84, DE 100 61 030 84, DE 20318 076 U1, DE 20 2004 016117 U1 and DE 203 05 291 U1. All brake elements disclosed there are, with appropriate dimensional design, insertable into the cavities of the hinges according to the invention. Obviously, use can also be made of commercially available silicon brakes in order to achieve a desired braking effect. Through the circumferential surfaces, which in the case of hinges according to the invention rub against one another, it is also possible to impress lubricant grooves into these or, if they consist of plastics material, to conjunctively form such grooves, into which a lubricant is then added or into which also a silicon can be injected .in order to lastingly achieve the desired movement damping on relative rotation of the components with respect to one another.

BRIEF DESCRIPTION

Figure 2:
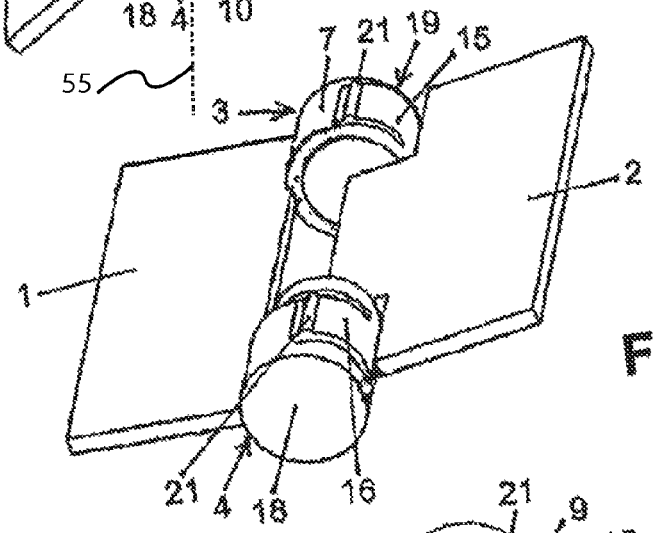
Figure 3:
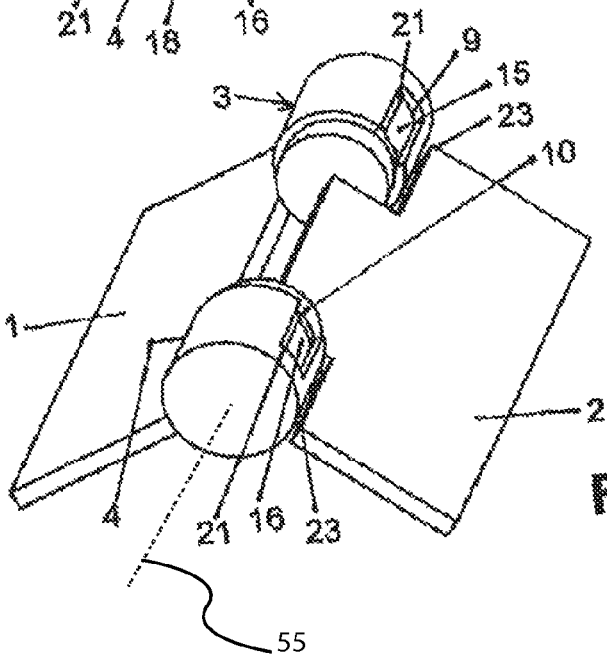
Figure 4:
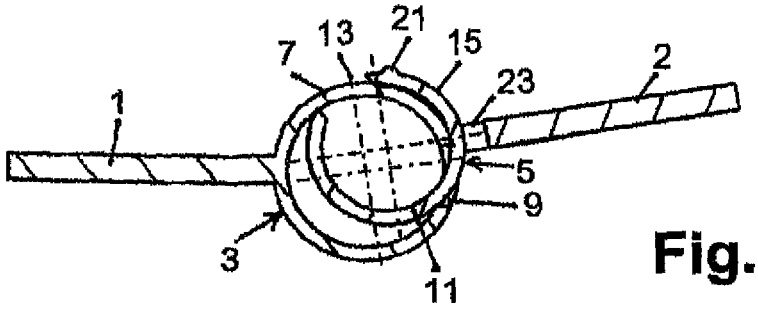
Figure 5:
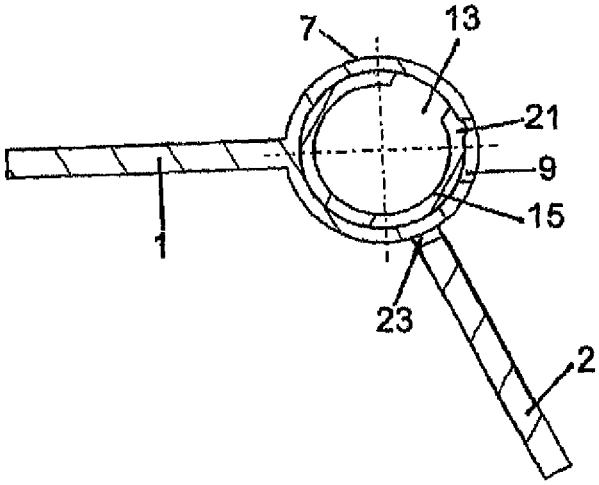
Figure 6:
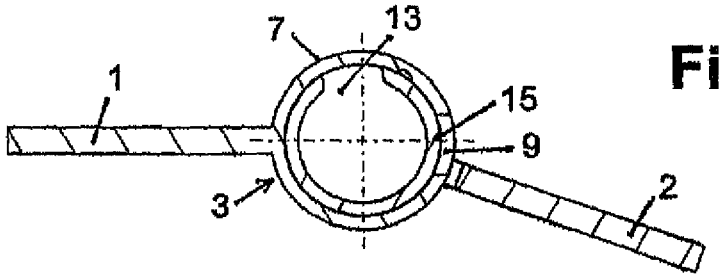
Figure 7:
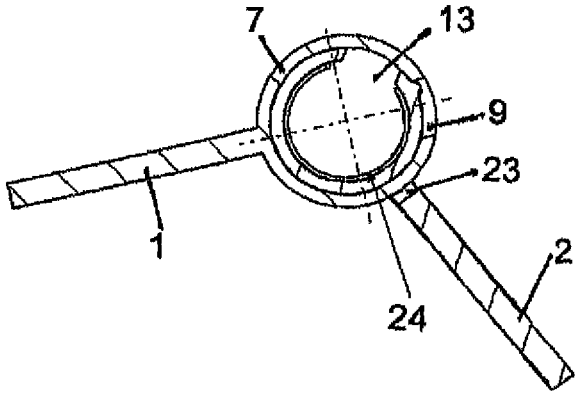
Figure 8:
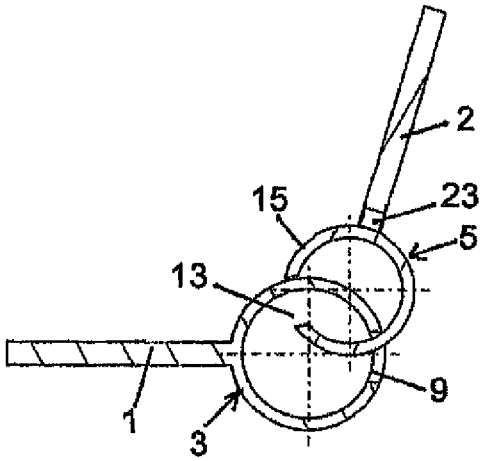
Figure 9:
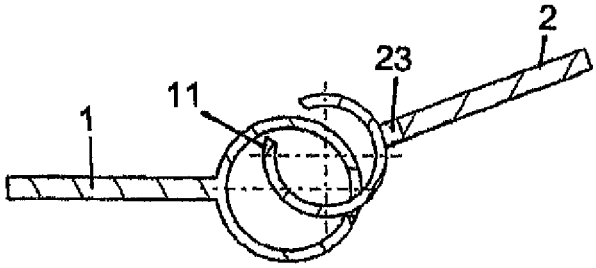
Figure 10:
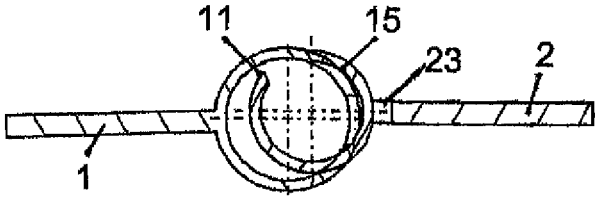
Figure 11:
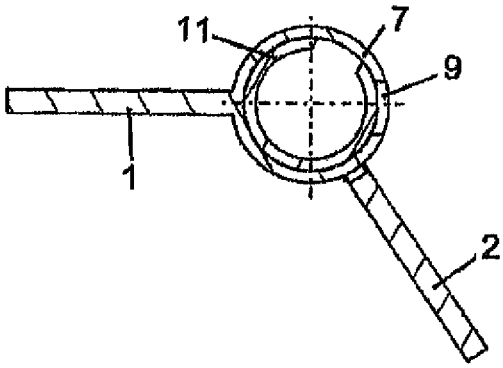

The invention is explained further in the following by way of the embodiments illustrated in the drawings, in which:

FIG. 1 shows, in an exploded illustration, two components with hinge elements according to the invention, FIG. 2 shows the partly rotated-together hinge elements according to FIG. 1, FIG. 3 shows the hinge elements according to FIG. 1 rotated one into the other, FIG. 4 shows, in a sectional side view, the hinge elements after introduction of the insertion sleeve into the longitudinal slot of the bearing sleeve, FIG. 5 shows two sleeves, which are rotated one into the other, in a detent setting, FIG. 6 shows the sleeves, which are rotated one into the other, in a clamping setting, FIG. 7 shows sleeves, which are inserted one into the other, with inserted C-ring, FIG. 8 shows, in sectional side view, two hinge elements, the insertion sleeve of which is introduced into the bearing sleeve via longitudinal gaps, wherein the insertion sleeve does not have a detent projection, FIG. 9 shows a hinge element according to FIG. 8 in a first rotational setting, FIG. 10 shows the hinge elements according to FIG. 8 in a further rotational setting and FIG. 11 shows the hinge elements in a rotational setting in which the two sleeves are rotatably mounted to engage one in the other.

DETAILED DESCRIPTION

All figures show a first component 1 of plastics material with integrally formed hinge elements 3, 4, which each consist of a bearing sleeve 7, 8 with respective closed bases 17, 18, the bases being mounted at the opposite ends, and which are provided with longitudinal gaps 9, 10 extending up to the bases. The longitudinal gaps 9, 10 are provided at the first component 1 approximately opposite the fastening sides of the first hinge elements 3, 4. The component is a plastics material molded part which is produced in an injection-molding method and at which the hinge elements 3, 4 are integrally formed. Provided congruently in correspondence with these bearing sleeves 7, 8 at a second component 2 are second hinge elements 5, 6 which are constructed as insertion sleeves 11, 12 and which each have a closed base 19 or 20, which sleeves are so attached opposite to one another to the second component 2 that a guide slot 23 is formed between the circumferential wall and the second component 2. This guide slot 23 can be formed to be longer than the insertion sleeve 5, 6. In addition, the component 2 can in this region be only a spacer part which corresponds with the spacing between the two bases 19, 20. The hinge elements can be coupled together to rotate about central axis 55. At least one of the hinge elements 3 can have a light or light element disposed therein. There is an opening 44 which is disposed within element 5 which allows a cable 42 for powering light 40 therein. In addition there is disclosed a silicon 0 ring 57 extending around an interior surface of hinge element 3 for allowing the sliding of these hinge elements together. In addition, there are brake elements 48, 49, 50, and 51 which can serve as brake elements to stop the rotation of hinges if necessary. These brake elements can serve as rotating brake elements, stationary brake elements, and cylindrical brake parts, and also serve as a brake means for selectively stopping the rotation of the cylinders of the hinge.

The insertion sleeves 11, 12 are radially fastened to the second component 2 at the base side and extend outwardly by the open sleeve wall. Longitudinal gaps 13, 14, which have a defined clear width, are similarly formed in the insertion sleeves. Moreover, the two sleeve sections 15, 16 on the right hand side are cut free relative to the base 19, 20, so that these sections are, with exploitation of the intrinsic elasticity, resilient. Two bead shaped detent elements 21, 22 are formed at these sections in the region near the gap. It will be evident that the insertion sleeves 11, 12 of the second hinge elements 5, 6 are insertable by the longitudinal gaps 13, 14 thereof into the longitudinal gaps 9, 10 of the bearing sleeves 7, 8 of the first hinge elements 3, 4 in a specific relative angular setting of the components 1, 2. They can then be rotated relative to one another, which is apparent from FIG. 2. In that case the circumferential walls 7, 8 enter the guide slots 23 and the resilient sleeve wall sections 15, 16 enter the interior space of the bearing sleeves 7, 8.

Through further relative pivotation and with utilization of the resilience of the sleeve wall sections 15, 16 as well as the resilience of the remaining circumferential wall sections of the sleeves it is achieved that the first hinge elements 3, 4 and the second hinge elements 5, 6 are rotated one into the other, which is evident from FIG. 3. The hinge can in this mode and manner be produced from the two plastics material molded parts. In that case, the detent elements 21, 22 enter, for example, the longitudinal gaps 9, 10 and bear, as apparent from FIG. 3, against one edge. If the two components 1, 2 are pivoted relative to one another, they can also slide over the edges of the longitudinal gaps 9, 10 and bear, under a defined stress, against the inner surface of the circumferential wall of the bearing sleeves 7, 8. The described assembly steps are illustrated in FIGS. 5 and 6. A special feature is illustrated in FIG. 7. Through the hinge elements slidingly guided together one in the other there is created between the sleeves a tube-spring stress which can be designed to be variable and thermostable through the C-spring inserted into the insertion sleeve.

In FIGS. 8, 9, 10 and 11 the sleeves without detent elements are illustrated in the assembly steps. Moreover, these figures shall demonstrate that even when a closed base is present at each of the bearing sleeves 7, 8 and the insertion sleeves 11, 12, insertion of the two sleeves one into the other is possible if the wall thicknesses and the material used permit a resilience which enables slight deformation of the end sections of the circumferential wall in the region of the longitudinal gaps during rotation of one into the other, but maintain their shape when the two sleeves have been rotated one into the other.

A hinge according to the invention can be used in many ways. The applications are, particularly, rotationally or pivotably mounted folding cover closures with high demands on strength, as in the case of covers of compartments in the field of automobile interiors in conjunction with pivotable parts in the automobile itself, in the toys industry in the case of toys, and in the field of domestic products. The range of use is unlimited. Depending on the respective design form and materials used, such hinges can, for example, also be employed as window hinges.

REFERENCE NUMERAL LIST

1 first component
2 second component
3 first hinge element
4 first hinge element
5 second hinge element
6 second hinge element
7 bearing sleeve
8 bearing sleeve
9 longitudinal gap
10 longitudinal gap
11 insertion sleeve
12 insertion sleeve
13 longitudinal gap
14 longitudinal gap
15 sleeve wall section
16 sleeve wall section
17 closed base
18 closed base
19 closed base
20 closed base
21 detent element
22 detent element
23 guide slot
24 C-ring-spring

The invention claimed is:

1. A hinge comprising: at least two pivotally connected components comprising:

a first component comprising at least one first round hinge element;

a second component comprising at least one corresponding second round hinge element, which the at least one first and second round hinge elements are connected together to be rotatable about a center axis, wherein the at least one first round hinge element is a bearing sleeve with a longitudinal gap, an insertion sleeve with a longitudinal gap is fastened to the second component as the at least one second round hinge element, an outer diameter of each insertion sleeve is matched to an inner diameter of each bearing sleeve and the outer diameter of each insertion sleeve is dimensioned so that with consideration of the resilient design of a circumferential wall, each insertion sleeve can rotate in each bearing sleeve, at least one sleeve wall section at the longitudinal gap of each insertion sleeve which is formed to be resilient and wherein each insertion sleeve is insertable by the longitudinal gap into a longitudinal gap of each bearing sleeve; through relative rotation of the components, each insertion sleeve can be rotated completely into each bearing sleeve, wherein each bearing sleeve of the at least one first round hinge element is fastened to or formed on the first component to protrude at the longitudinal side in such a manner that the longitudinal gap is disposed in the region of a circumferential wall of each bearing sleeve opposite a fastening section, each insertion sleeve fastened to the second component is fastened on at least one end face in such a manner that the circumferential surface of each insertion sleeve is circumferentially free, and the longitudinal gap of each insertion sleeve is freely accessible for insertion into the longitudinal gap of each bearing sleeve; and wherein said at least one resilient sleeve wall section is a cut-free resilient sleeve wall section which adjoins the longitudinal gap of each bearing sleeve of the at least one first round hinge element.

2. The hinge according to claim 1, wherein each bearing sleeve with open or closed base are arranged at the first component and correspondingly thereto at least one respective insertion sleeve in paired arrangement with open or closed base are arranged at the second component.

3. The hinge according to claim 1, wherein each insertion sleeve and each bearing sleeve are of cylindrical form and each have at an end face, a base or an annular flange wherein two bases or the annular flanges are arranged oppositely at the outer side referred to as a pair of hinge elements rotatable one into the other.

4. The hinge according to claim 1, where the sleeve circumferential wall of each insertion sleeve and each bearing sleeve are of resilient construction.

5. The hinge according to claim 1, wherein each insertion sleeve has at the sleeve circumferential wall, at least one detent element protruding at the outer side as a brake surface or a brake element.

6. The hinge according to claim 5, where each bearing sleeve has at the inner side at the sleeve circumferential wall, at least one detent receptacle for the detent element or that the detent element on pivotation of the components has detenting engagement in the longitudinal gap of the bearing sleeve.

7. The hinge according to claim 6, further comprising several detent receptacles disposed over the circumference of the inner surface of each bearing sleeve for several detent settings.

8. The hinge according to claim 1, wherein the circumferential wall of each bearing sleeve and each insertion sleeve have at least one tongue-shaped spring element which protrudes from the surface of the insertion sleeve or into the interior space of each bearing sleeve and that the respective mating sleeve has in the region of the spring element a stiffly resilient wall section or a non-resilient wall section.

9. The hinge according to claim 1, wherein the hinge elements consist of a plastic material or metal.

10. The hinge according to claim 1, wherein the hinge elements together with the respective components consist of a plastics material and are each of integral construction.

11. The hinge according to claim 1, wherein a spring-loaded element defining the friction force between each insertion sleeve and each bearing sleeve is inserted into the insertion sleeve.

12. The hinge according to claim 1, further comprising:

A cable for connection of energy consumers is led in an axial direction through at least one arrangement consisting of two hinge elements.

13. The hinge according to claim 1, further comprising a flat or annular silicon insert disposed between the mutually adjoining surfaces of the hinge elements or hinge grooves for reception of other slide means or brake means are formed in at least one of the circumferential surfaces of each insertion sleeve or each bearing sleeve.

14. The hinge according to claim 1, further comprising brake elements comprising mechanical, electromechanical or magnetic brake elements disposed in a cavity of the hinge elements and produce a force-dependent movement path of the thus damped hinge.

15. The hinge according to claim 14, further comprising a rotating brake element disposed in an internal cavity of each hinge element, wherein the casing of each bearing sleeve is extended and the stationary brake part is fixed thereon and the cylindrical brake part engages in the cavity of each insertion sleeve and acts directly on the sleeve inner wall.

16. The hinge according to claim 1, further comprising a lighting element coupled to at least one of the hinge elements; a cable connection, which is led through a bore in one end wall and which is inserted into said at least one the hinge elements, or another functional insert which emits light from the open end face.

* * * * *